US006206463B1

(12) United States Patent
Whigham

(10) Patent No.: US 6,206,463 B1
(45) Date of Patent: Mar. 27, 2001

(54) COMBINED CARRYING CASE AND FOLDING SEAT

(76) Inventor: Jewel A. Whigham, 650 34th St., Riviera Beach, FL (US) 33404

( * ) Notice: Subject to any disclaimer, the term of this patent is extended or adjusted under 35 U.S.C. 154(b) by 0 days.

(21) Appl. No.: 09/160,432

(22) Filed: Sep. 24, 1998

Related U.S. Application Data

(60) Provisional application No. 60/060,135, filed on Sep. 26, 1997.

(51) Int. Cl.[7] ..... A47C 13/00

(52) U.S. Cl. ..... 297/129; 297/217.3; 297/284.5

(58) Field of Search ..... 297/252, 129, 297/284.4, 284.5, 284.6, 284.7, 118, 188.01, 217.1, 214.3; 190/8; 224/155; 601/49, 91, 98

(56) References Cited

U.S. PATENT DOCUMENTS

| | | | | |
|---|---|---|---|---|
| 119,162 | * | 9/1871 | Lutz | 297/17 X |
| D. 121,266 | | 7/1940 | Archer . | |
| 168,402 | * | 10/1875 | Laumonier | 297/17 X |
| D. 171,506 | | 2/1954 | Laird . | |
| D. 194,234 | | 12/1962 | Ross . | |
| D. 219,377 | | 12/1970 | Peery . | |
| 1,161,420 | * | 11/1915 | Snelling | 297/252 |
| 1,275,649 | * | 8/1918 | Blando | 297/17 |
| 2,466,361 | * | 4/1949 | Bjornskaas | 297/252 |
| 2,536,157 | * | 1/1951 | Campanelli | 297/252 |
| 2,894,565 | * | 7/1959 | Conner | 297/284.7 |
| 2,915,154 | | 12/1959 | Holder . | |
| 3,092,244 | | 6/1963 | McWhirter . | |
| 3,120,404 | * | 2/1964 | Bramming | 297/252 X |
| 3,404,915 | * | 10/1968 | De Souza Filho | 297/17 |
| 3,422,938 | | 1/1969 | Worcester . | |
| 3,594,039 | * | 7/1971 | Harp | 297/252 |
| 4,006,739 | * | 2/1977 | Wahl | 128/33 |
| 4,079,992 | | 3/1978 | Thrift et al. . | |
| 4,502,728 | | 3/1985 | Sheldon et al. . | |
| 4,518,200 | * | 5/1985 | Armstrong | 297/284.7 X |
| 4,718,724 | * | 1/1988 | Quinton et al. | 297/284.5 |
| 4,730,871 | | 3/1988 | Sheldon . | |
| 4,746,166 | | 5/1988 | Sadan . | |
| 4,781,413 | * | 11/1988 | Shumack, Jr. | 297/252 |
| 5,289,958 | * | 3/1994 | Jay | 297/129 X |
| 5,297,304 | * | 3/1994 | O'Sullivan | 297/284.5 X |
| 5,357,642 | * | 10/1994 | Clute | 5/655 |
| 5,421,637 | | 6/1995 | Lemburg . | |
| 5,516,188 | * | 5/1996 | Bruhnke et al. | 297/252 X |
| 5,516,193 | * | 5/1996 | Simpson | 297/252 |
| 5,584,422 | * | 12/1996 | Bond-Madsen | 297/129 X |
| 5,588,696 | * | 12/1996 | Jay et al. | 297/129 |
| 5,701,979 | * | 12/1997 | Voich | 297/129 X |
| 5,836,900 | * | 11/1998 | Leventhal | 297/284.5 X |

FOREIGN PATENT DOCUMENTS

| | | | | |
|---|---|---|---|---|
| 3904 | * | 9/1931 | (AU) | 297/129 |
| 406319 | * | 9/1970 | (AU) | 297/284.5 |
| 2556197 | * | 6/1985 | (FR) | 297/284.7 |
| 1192956 | * | 5/1970 | (GB) | 297/284.4 |

* cited by examiner

*Primary Examiner*—Milton Nelson, Jr.
(74) *Attorney, Agent, or Firm*—Ted W. Whitlock

(57) ABSTRACT

A combination carrying case and cushioned seat is described which conveniently provides therapeutic support for the lumbar region of the spine. Specifically, the item described is a foldable carrying case which provides a cushioned seat and backrest, as well as a separate, adjustable pad which supports the lumbar spinal region.

7 Claims, 6 Drawing Sheets

COMBINED CARRYING CASE AND FOLDING SEAT

CROSS-REFERENCE TO RELATED APPLICATIONS

This a continuation-in-part from U.S. Provisional Patent Application Ser. No. 60/060/135, filed Sep. 26, 1997.

FIELD OF INVENTION

This invention relates generally to portable seating devices and more particularly to a briefcase or backpack and folding cushioned seat combined as a single article of manufacture. The article can serve as a case for carrying various articles, including papers, books, clothing, or the like and as a seat with a backrest which has a specialized lumbar support.

BACKGROUND OF THE INVENTION

Various portable chairs having seats arranged for disposition directly upon a supporting surface such as the ground, beach, etc., have been disclosed in the literature. Examples of such prior art chairs are shown in U.S. Patent Nos. D 121,266, D1 71,506, D1 94,234, D219,377, and 2,915,154. While such chairs are generally suitable for their intended purpose they leave much to be desired from the standpoint of efficiency and adaptability for multi-purpose use and for providing lumbar support.

U.S. Pat. No. 3,092,244 (O'Neil) discloses a portable seat which can also serve as a carrying case. To that end, the structure comprises a pair of side walls each having a convex outer surface and a concave inner surface. The side walls are connected together at a hinge and are pivotable from a first position to a second position. The structure includes a handle formed of a pair of frame-like members. One frame member is pivotally connected to one of the side walls and the other frame member is pivotably connected to the other side wall. One side wall forms a seat whereas the other side wall is oriented at an angle to the seat to form a backrest.

In U.S. Pat. No. 3,422,938 (Worcester), there is also disclosed a portable seat which can serve as a carrying case. The structure of Worcester comprises a pair of walls having mating peripheral edges. One of the walls forms an inner concavity between its edges. The walls are connected together at a hinge to enable the walls to be swung to a closed position to enclose the concavity and thereby form a storage compartment or to be swung to an open position wherein one of the walls forms a seat and the other wall forms a backrest. A handle is provided to enable the carrying of the device when closed and to aid in the bracing of the wall when it is serving as the backrest.

U.S. Pat. No. 4,079,992 describes a combination carrying case and folding seat which is arranged to be disposed directly on a supporting surface, such as the ground. First and second shell-shaped members are pivotably connected together at their rear by a hinge. The device also includes a third member removably mounted over the first member and closing the hollow interior of the first member for storage of items therein. The third member forms a seating surface of the device. Flanges are provided to form a vertical support for the unit when said unit is in its closed position, with one of the flanges serving as a brace for the second member when the device is in its open or seating position.

U.S. Pat. No. 4,730,871 describes a backrest construction which may be incorporated into an upholstered chair or recliner, or which may be used in a portable backrest either alone or in combination with a seat. The construction includes a frame with a vertical track carried on it and which in turn carries a lumbar support that may be moved up and down on the track. The lumbar support not only may be moved vertically to adjust its height, but in addition, it may be moved toward and away from the plane of the frame so as to decrease or increase the support provided by it.

U.S. Pat. No. 4,746,166 discloses a portable seat and carrying case, comprising first and second side wall members hinged to each other and rotatable between a closed, case-fashion position and an open, seat-fashion position. Each identical side wall member comprises a pair of outwardly directed, concentric circular bearing surfaces, one being formed outside a projection and the other inside a recess. The projecting bearing surface of one side matches the recessed bearing surface of the other side of each of the side wall members, and, when coupled to each other, form a hinged connection therebetween. A bottom member forms part of and rotatably supports the side wall members in their coupled position.

U.S. Pat. No. 4,502,728 describes a portable seat and backrest that can be folded for convenient carrying which includes a seat and backrest having spring steel plates as frames and covered by foam pads. The curvature of the backrest is controlled by a slide assembly movable on tracks on the rear of the backrest.

U.S. Pat. No. 5,421,637 describes a foldable stadium seat and storage apparatus which includes a seat portion assembly, a storage assembly, and a first hinge assembly connecting the seat portion assembly and the storage assembly together. The first hinge assembly is connected between the interior side of the seat portion assembly and the interior side of the storage assembly. A strap is employed that is capable of encompassing the seat portion assembly and the storage assembly for retaining the interior side of the seat portion assembly and the interior side of the storage assembly in juxtaposition when the foldable stadium seat and storage apparatus is in a folded orientation. The seat portion assembly includes a first end proximal to the first hinge assembly, and a handle is connected to the first end of the seat portion assembly. The storage assembly includes a hollow chamber portion defined by rigid walls of the storage assembly. The storage assembly includes a cylindrical well portion for retaining a beverage can. The storage assembly also includes a first expandable storage chamber and a second expandable storage chamber. A backrest portion may be connected to a distal end of the seat portion assembly by a second hinge assembly.

Despite these articles being described or available, there has been no specific combination of a carrying case which can be used as a cushioned seat which further can provide the advantage of lumbar support.

BRIEF SUMMARY OF THE INVENTION

Accordingly, it is a general object of the instant invention to provide a carrying case which can also serve as a seat having an advantage of providing lumbar support.

It is a further object of this invention to provide a device forming a comfortable seat and backrest with lumbar support which can be readily converted to a simple folding carrying case with substantial internal or external storage space.

It is yet a further object of this invention to provide a small and lightweight combination folding seat and carrying device.

It is yet a further object of this invention to provide a readily portable seat and carrying case having significant aesthetic appeal, e.g., having the appearance, when folded, of an expensive, high quality carrying case or backpack.

These and other objects of the instant invention are achieved by providing a combination carrying case and folding seat for disposition directly upon a seating surface, e.g., an uncushioned chair or bench, having a seat portion and a backrest portion. The subject device comprises first and second side walls which are substantially planar and opposing one another when in a folded configuration. The side walls form the back and seat support portions of the device and are adjoined at an articulated joint or hinge. Cushioned members are disposed between the first and second side walls. The first side wall comprises a generally planar surface serving as a base for the cushioned seat member which forms a seating surface. The second side wall has an inner surface on which a cushioned member can also be disposed. The second side wall is pivotable relative to the first side wall about the articulated joint and forms a backrest for the cushioned seat. In a closed position, the side walls are folded at the joint so that the inner faces of the side walls are juxtaposed opposite each other. The side walls can have flanged edges so that the folded side walls can form a storage compartment therebetween. For fastening together the case, a fastening means, e.g., a zipper or a strap can be provided for maintaining the case in a closed position.

In an open position the second side wall forming the backrest can extend at an angle of at least 90° relative to the seating surface to form a backrest for the seat. Disposed on the inner surface of the second side wall is a lumbar support means which, preferably, is adjustable in a substantially top to bottom direction relative to the backrest in its upright position. A cushioned liner can also be disposed on the inner face of the backrest for comfortable or therapeutic support for areas of the back other than the lumbar region, e.g., the thoracic or sacral regions.

An adjustable sliding mechanism allows for direct contact of a lumbar support pad with the lumbar region of the spine, thereby helping to alleviate discomfort which can be caused by muscle tension, sciatica, radiculopathy, or the like. This is achieved by decompression of the vertebral disc while providing a secure stable support system for the lumbar region of the spine during prolonged sitting. This device is thus uniquely designed to promote correct spinal alignment during prolonged sitting; reduce discomfort associated with common back problems; provide a firm seat adaptable for most school desks, office chairs, and arena seats; and provide for a convenient way to carry various items normally carried in a carrying case.

Other objects and advantages of the instant invention will be readily appreciated by the description provided herein when considered in connection with the accompanying drawings.

DETAILED DESCRIPTION OF THE INVENTION

Figure 1:
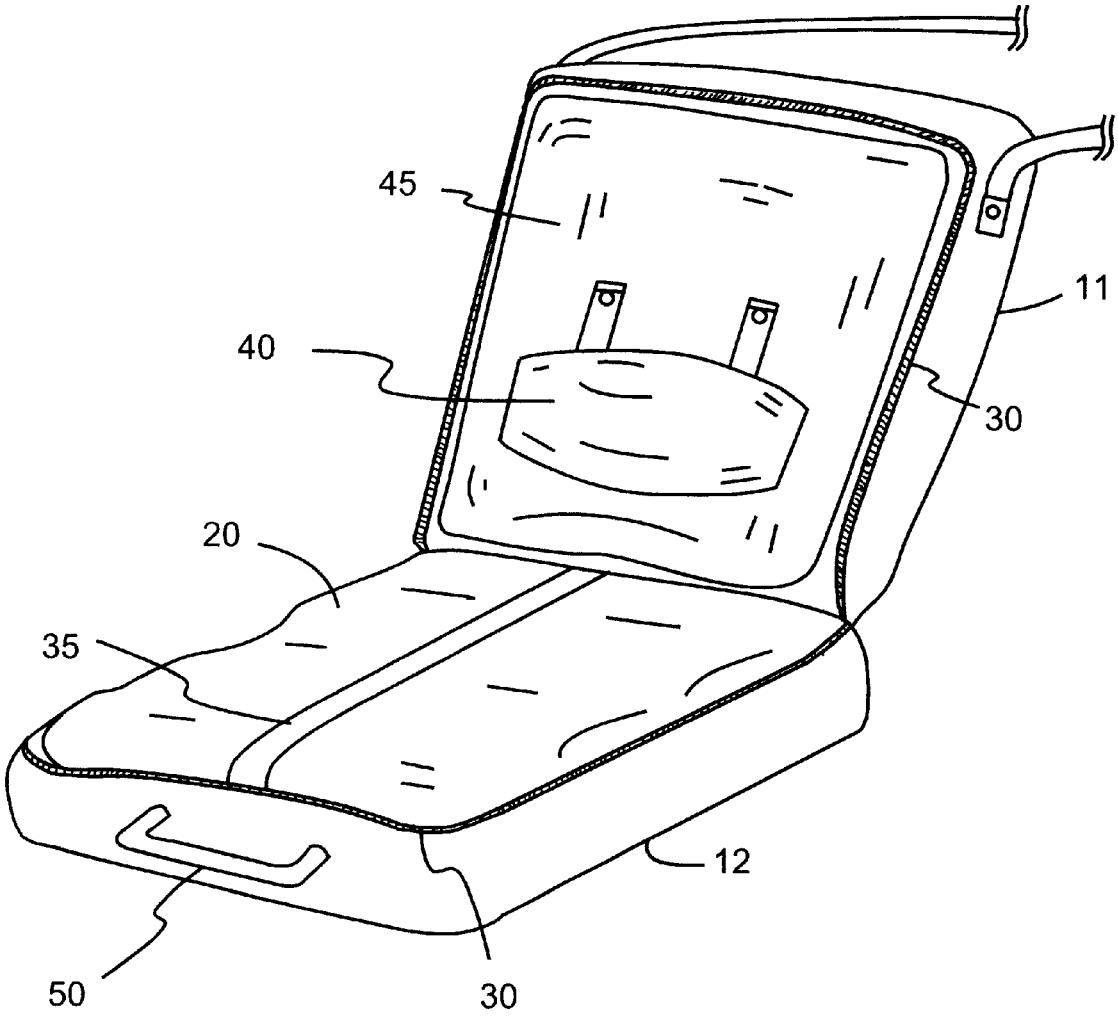
FIG. 1 shows a perspective view of an embodiment of an article of manufacture according to the subject invention, wherein the article is in an open configuration to be used as a cushioned seat.
Figure 3:
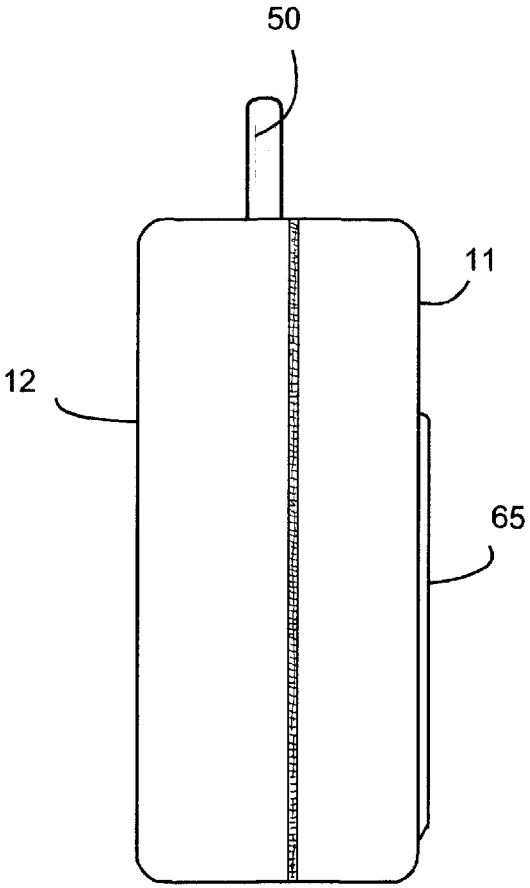
FIG. 3 shows a side view of an embodiment of an article of manufacture according to the subject invention.
Figure 2:
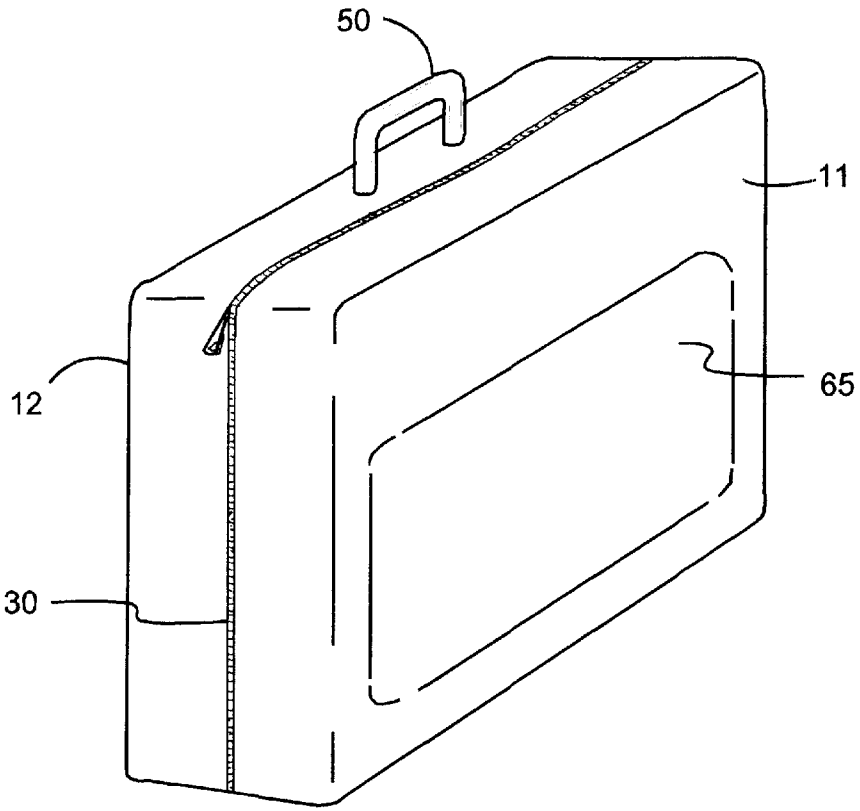
FIG. 2 shows a perspective view of an embodiment of an article of manufacture according to the subject invention in a closed position, wherein the article is in a closed configuration to be used as a briefcase or carrying case.
Figure 4:
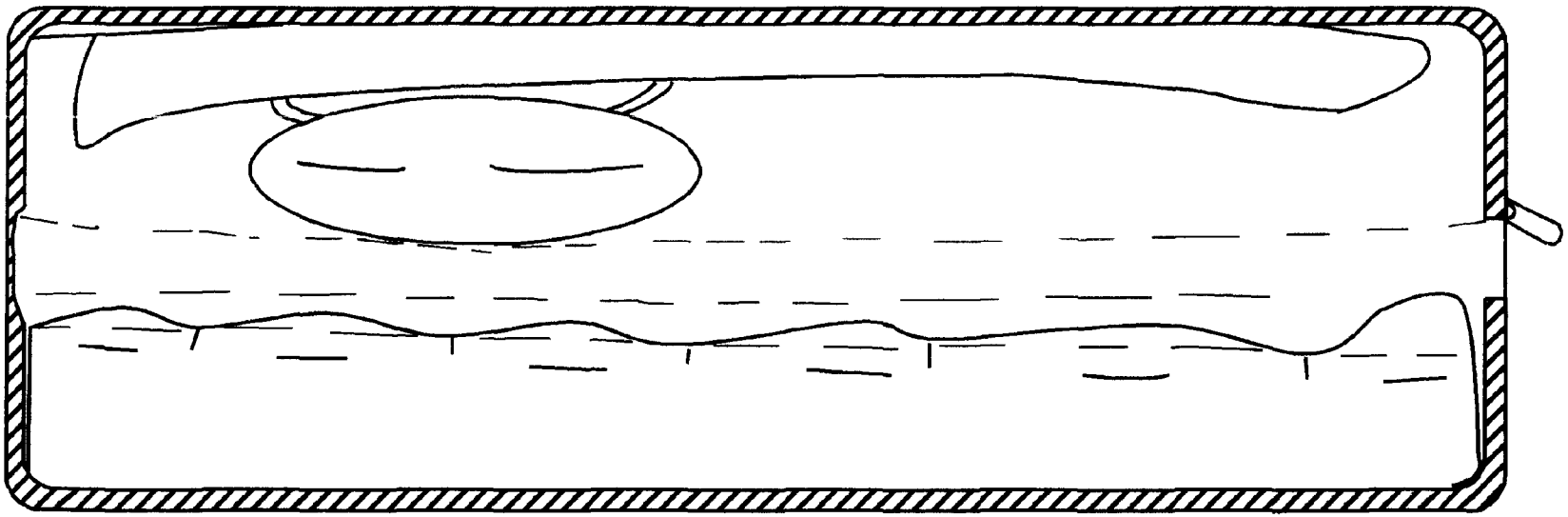
FIG. 4 shows a cut-away side view of an article of manufacture according to the subject invention illustrating the configuration wherein, in a closed position for the article, a lumbar support pad is received by a recess in the contoured cushioned seat. This Figure also shows a cavity created between the backrest and cushioned seat members wherein items can be stored for carrying in the carrying case.

The subject invention concerns a combination carrying case and cushioned seat which can provide excellent lumbar support. The carrying case/cushioned seat of the instant invention can perhaps be best understood by reference to the accompanying drawings, provided herein as FIGS. 1–7.

One embodiment, shown in FIGS. 1–4, the subject combination carrying case and cushioned seat, shown generally as 10, comprises two opposing side walls 11 and 12, both of which have an outer and inner face. The inner face of side wall 12 forms a seat means when the article is in an open position. Preferably, the side walls comprise a laminated structure wherein separate layers of an outer and inner material form the outer and inner faces of the side walls. These outer and inner materials are typically flexible or pliable material, e.g., leather, vinyl, canvas, or the like. Accordingly, a third layer of a material more rigid than the side wall material can be disposed between the inner and outer layers to provide a permanent shape. For example, the third layer can be polystyrene or polyvinyl chloride (PVC). The material forming the third layer can be flexible or rigid so long as it substantially retains its general shape. In one embodiment of the invention, the third layer can be slightly curved, preferably convex relative to the outer face and concave relative to the inner face such that it is contoured to fit the curves of the body. In another embodiment, the third layer supporting the backrest is disposed on the inner layer of the second side wall forming a spinal support plate 45.

In a preferred embodiment, a cushioning means 20 can be disposed on the inner face of the side wall 12 to form a seat cushion. More preferably, the cushioning means is permanently affixed to the inner face of side wall 12, and covers substantially the entire surface area of the inner face, leaving uncovered an area around the perimeter of the inner face to allow for providing an end wall 13 perpendicular to the side walls which can advantageously comprise a closure means 30 for closure of the carrying case.

In a preferred embodiment, the cushioning means or seat cushion comprises a commonly used cushioning material, e.g., foam rubber, or other commercially available material, such as a polymer having cushioning properties. Typically, the cushioning material is a high density foam of high grade (2570) or medium grade (2550). For comfort and durability, the cushion material can be covered with fabric or other material typically used for covering cushion material for seat cushions. In addition, the cushioning means can be contoured to conform to the body of a person using the article as a seat cushion. The seat cushion can be stitched for a ribbed effect which can add to comfort and aesthetic appeal for this article. All portions of the subject invention which come into contact with the body during use as a seat can be sloped and contoured in direct correlation to the curvatures of the body, e.g., the vertebral column, specifically, the thoracic and lumbar regions.

In one contoured embodiment, the thickness of the seat cushion varies from front to back (the back being the face proximate to the backrest) or from side to side. Preferably, the thickness of the seat cushion is greater on the sides relative to the thickness of the cushion in the central area of the seat. Further, it is preferred that the thickness of the cushion and is greater in the front relative to the thickness of the back of the seat cushion. A seat cushion contoured such that its thickness is greater in the front than the back provides an advantage of receiving a lumbar support, described in more detail below, when the article of the subject invention is in its closed position.

Figure 5A:
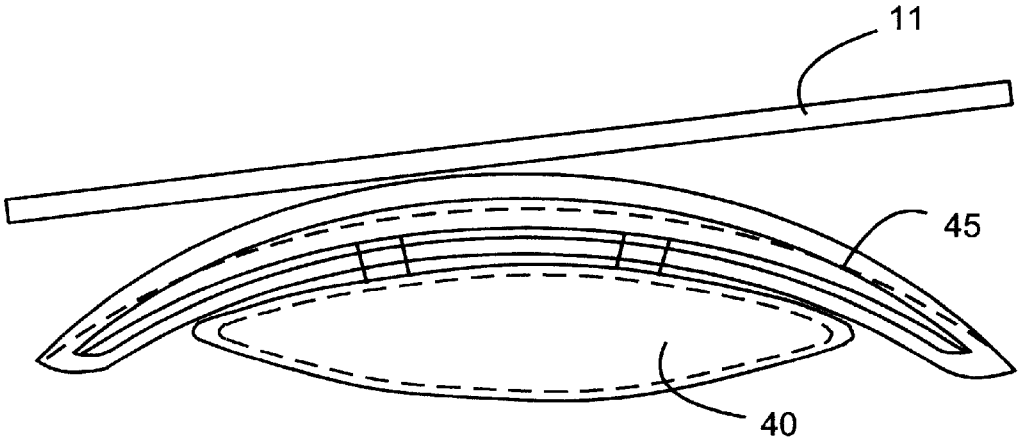
FIGS. 5A and 5B show a top view of the lumbar support pad and spinal support plate which are disposed on the inner face of the side wall forming the backrest of the subject invention.
Figure 5B:
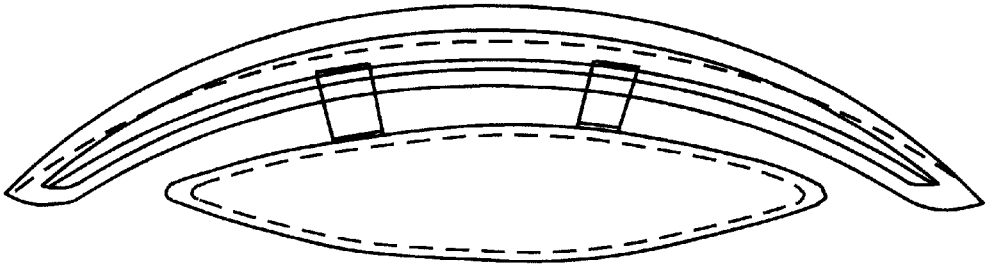
Figure 6A:
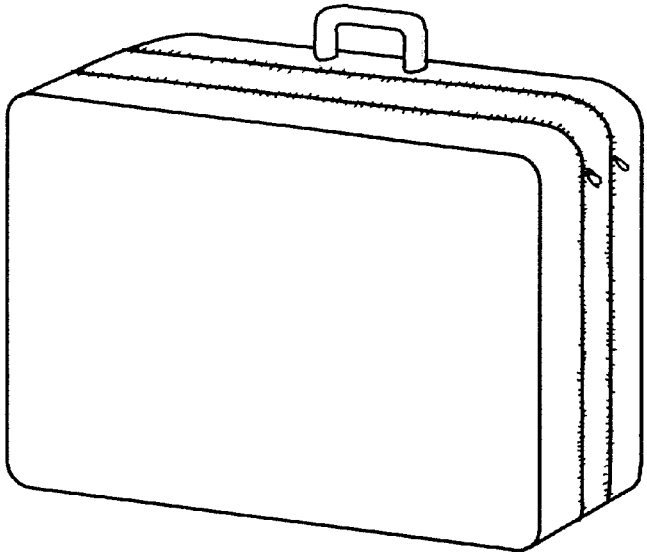
FIG. 6A shows a perspective view of a variable configuration of the subject invention illustrating an embodiment having three separate sections forming an least two openings or compartments.
Figure 6B:
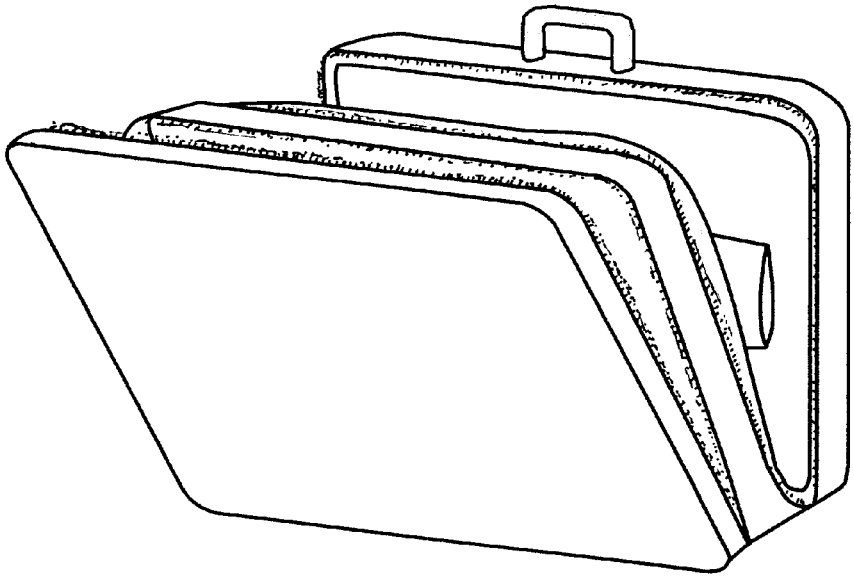
FIG. 6B shows the embodiment of FIG. 6A, further illustrating the two compartments in a partially open configuration to demonstrate.

A lumbar support cushion 40 can be disposed on the inner face of the side wall 11 forming the backrest of the subject invention. The overall design of the lumbar support is uniquely designed to provide therapeutic support during prolonged sitting periods. The lumbar support comprises a cushion which, in cross section, can be substantially semicircular or ovoid. The cushion can be rectangular or generally ovoid in its parametric shape, but preferably is wider in its horizontal dimension than its height in the vertical position. The lumbar support cushion is preferably formed substantially entirely of cushioning material. In one embodiment, the lumbar support cushion is thicker toward its middle and is tapered toward its horizontal ends. The lumbar support pad is preferably of a thickness at its thickest point to be level with the outer edges of the concave face of the spinal support plate. This configuration for the lumbar support cushion is illustrated in FIGS. 5A and 5B.

Further embodiments of the lumbar support pad include an insert disposed within the cushion material to modify the temperature of the lumbar support pad or to provide other additional therapeutic effects, e.g., massage, magnetic or vibration therapeutic modalities. Typically, such an insert is commercially available and can be accommodated into the lumbar support pad by an opening into the pad. Preferably, this opening is closeable by a standard closure means, e.g., zipper, Velcro, snaps, or the like. An embodiment having a zipper-closeable opening 46 for providing an insert 47 (shown in phantom) within the lumbar support pad is shown in FIG. 5B.

For temperate regulation of the lumbar support, a standard gel-pack can be used. These gel-packs can be heated in a microwave oven or can be stored in a refrigerated area or freezer prior to usage, according to the desired effect. Vibrating means can be provided and are typically battery operated for convenience of providing mobility, i.e., are not restricted to electric power requiring plugging the vibrating means into a wall socket or other electric power source.

Alternatively, the lumbar support pad can be disposed on a spinal support plate 45 which is disposed on the inner face of the backrest. The spinal support plate is generally a curved sheet having a concave face toward the back of the user and a convex face toward the inner face of the backrest. The spinal support plate is formed from a shape-retaining plastic or polymer material, e.g., polystyrene or polyvinyl chloride (PVC). Preferably, the spinal support plate is about one-sixteenth inch in thickness when made from polystyrene and is about one-eighth inch in thickness when made from PVC. Overlaying the spinal support plate can be a cushioning layer.

The cushioning layers for the lumbar support pad and the spinal support plate can be any material having cushioning properties, e.g., foam rubber, a cushioning polymer, or other material typically or commonly used in seat cushions. For example, buckwheat husk-filled cushions are currently popular. The cushioning material is preferably of a thickness to provide a comfortable cushion to the user, but not of a thickness which precludes easy closure of the carrying case. The cushioning material used for the lumbar support pad or spinal support plate can be covered by a fabric or other like material typically used for covering seat cushions. The fabric or other material covering the cushion can enhance durability of the article and comfort for the user.

Advantageously, the lumbar support pad of the subject invention can be placed at various positions from top to bottom along the inner face of the backrest. These various vertical positions for the lumbar support pad allow the pad to be adjusted according to the user's preference. The pad can be removably affixed to the backrest or spinal support plate by any attachment means 48 which allows for adjustment of the pad's position. For example, the pad can be affixed to the backrest by means of a hook and loop material, e.g., VELCRO. The backrest or spinal support plate can have distinct placements of the hook and loop material such that a plurality of positions can be provided for, but are predetermined fixed positions. Alternatively, the hook and loop material can be provided as a continuous strip on the inner face of the backrest or spinal support plate such that a plurality of positions for the pad can be achieved along a continuum. In other words, the pad can be placed at any position so long as it attaches along the strip of hook and loop material disposed on the backrest or support plate.

In another embodiment, the lumbar support pad can be affixed to the backrest or support plate by means of an elastic retaining strap. The elastic retaining strap comprises an elastic material forming a strap, wherein the length of the strap is positioned along the vertical axis of the of the backrest. The strap is affixed to the backrest or support plate in a manner such that the two ends of the strap meet to form a loop which extends through the backrest or support plate to affix the strap thereto. Alternatively, the strap can be directly affixed to the backrest or support plate.

The strap is looped through a notch or aperture provided in the back of the lumbar support pad to hold the pad such that it bears on the backrest or support plate without slipping out of position. To adjust the pad, the pad can be lifted or pulled away from the backrest and slidingly positioned along the strap as desired. Releasing the pad, the elastic strap holds the pad in that chosen position. A plurality of straps can be provided. Preferably, the subject invention comprises two straps, engaging the back of each end of the pad. Other means for affixing the strap to the backrest, support plate, or lumbar support pad would be readily recognized by persons of ordinary skill in the art. For example, a strap having apertures at distinct positions along the length of the strap, similar to holes in a belt, can be provided for adjusting the position of the lumbar support pad. The strap can be affixed to the backrest or support plate using snaps, buttons, rivets, or other like fastening means.

It would be understood that the term "lumbar" support pad is used for convenience and is not limited to support of the lumbar region of the spinal column. Adjustment of the support pad to different heights or positions can support a region of the spinal column, e.g., thoracic spinal region, in addition to the lumbar region.

For use as a carrying case, the subject invention comprises a closure means 30 which is provided on substantially at least three flanged edge walls formed perpendicular to the side walls. The side walls of the subject carrying case can be made from materials typically used for briefcases, e.g., leather, vinyl, canvas, or like fabrics. The fastening means 30 for securing the case in a closed position can preferably be a zipper. In a preferred embodiment, the zipper has two slidable closures which engage and close the teeth of the zipper when moved toward one another. Most preferable, the zipper closure means is provided in a configuration which is substantially curved along flanged edge wall 14 (see FIG. 2) so that advantageously the seat forms a raised area between the legs of the user and in the backrest is formed an area which is recessed for conforming to the back of the user.

The fourth edge of the side walls comprises a connecting material or fabric providing a flexible juncture for opening the carrying case similar to a hinged joint. The subject invention does not require, but can include, hinges. It would also be understood by those of ordinary skill in the art that the flexible joint can be formed by a single sheet of material which is folded on itself to form both side walls.

Papers, books, or other small articles can be placed between the seat cushion and backrest and can be easily carried when the carrying case is in a closed configuration. To increase the carrying capacity of the carrying case, an additional compartment, a flap or pocket 65 can be provided on the outer face of at least one of the side walls. A closure means, e.g., zipper or VELCRO, can be included to provide access to the additional compartment. In addition, a strapping means 35 can be provided inside the carrying case which straps across the seat cushion to hold an item, e.g., a laptop computer or similar item, when it is preferable to reduce shifting of the item while being carried.

The subject invention can also include a handle 50 for convenient carrying in a closed configuration, or adjustment of position in the seat or bench when in an open configuration. A shoulder strap can also be provided for conveniently carrying the article of the subject invention.

Figure 7A:
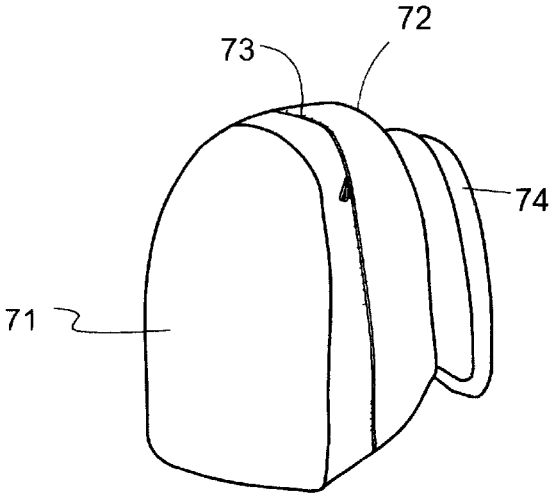
FIG. 7A shows a perspective view of an embodiment of the subject invention illustrating in a backpack configuration.
Figure 7B:
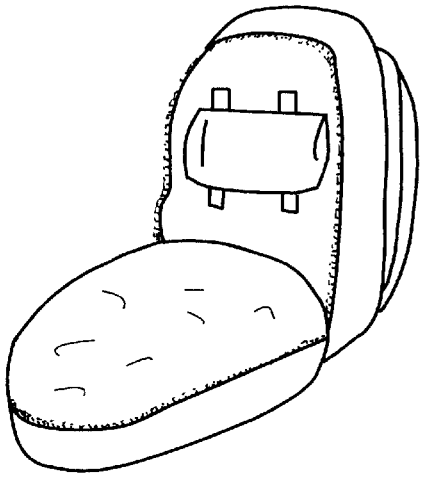
FIG. 7B shows a perspective view of the embodiment of the subject invention illustrated in FIG. 7A in an open position.
Figure 7C:
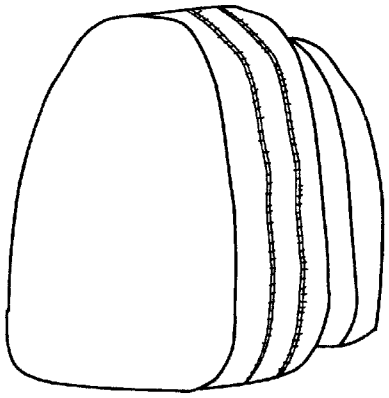
FIG. 7C shows a perspective view of a variation of the backpack configuration, having three separate sections forming at least two openings or compartments
Figure 7D:
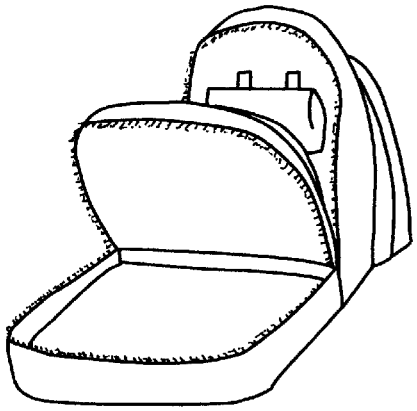
FIG. 7D is a perspective view of the backpack configuration of FIG. 7C in an open position.

In yet another embodiment, the carrying case can be configured as a backpack having the seat, back, and spinal support components described above adapted for use in the backpack embodiment. The backpack configuration is shown in FIGS. 7–7D. FIG. 7A shows the backpack configuration in a closed position, illustrating the front wall 71, back wall 72, and closure means 73. In addition, the backpack configuration can include a shoulder strap 74 for facilitating carrying thereof. Further, the backpack embodiment of the subject invention can include a double-compartment, as shown in FIGS. 7C and 7D, similar to the double compartment configuration of the briefcase embodiment described herein above.

It should be understood that the examples and embodiments described herein are for illustrative purposes only and that various modifications or changes in light thereof will be suggested to persons skilled in the art and are to be included within the spirit and purview of this application.

I claim:

1. A combination carrying case for protectively carrying a portable computer and portable seat comprising A laminated semi-rigid to rigid front wall, a laminated semi-rigid to rigid back wall, and a laminated semi-rigid to rigid edge wall perpendicularly connecting the front and back wall wherein a closure means is provided integral with the edge wall for opening or closing a storage compartment formed between the front and back wall said compartment capable of protectively storing a computer within said semi-rigid to rigid walls, said front and back walls each having a cushion disposed thereon, and said back wall further forming a backrest having a separate spinal support cushion adjustably affixed thereto.

2. The combination carrying case and portable seat of claim 1, wherein the adjustable spinal support cushion contains a means for providing massage or vibration therapy to a user of the seat.

3. The combination carrying case and portable seat of claim 1, wherein the spinal support cushion is capable of being adjustably positioned in relation to the backrest to provide lumbar spinal support for a person using the portable seat.

4. The combination carrying case and portable seat of claim 1 wherein the carrying case is fashioned as a briefcase.

5. The combination carrying case and portable seat of claim 1, wherein the carrying case is fashioned as a backpack.

6. The combination carrying case and portable seat of claim 1, wherein the carrying case includes a plurality of compartments.

7. The combination carrying case and portable seat of claim 1, wherein the adjustable spinal support cushion contains a means for modulating the temperature of said cushion.

* * * * *